United States Patent [19]

Sanpe

[11] Patent Number: 4,969,015

[45] Date of Patent: Nov. 6, 1990

[54] CLEANING DEVICE FOR AN ELECTROPHOTOGRAPHIC APPARATUS

[75] Inventor: Atsushi Sanpe, Yokohama, Japan

[73] Assignee: Ricoh Company, Ltd., Tokyo, Japan

[21] Appl. No.: 451,992

[22] Filed: Dec. 18, 1989

[30] Foreign Application Priority Data

Dec. 20, 1988 [JP] Japan ..... 63-319463

[51] Int. Cl.[5] ..... G03G 21/00

[52] U.S. Cl. ..... 355/297; 355/296; 355/299; 355/301; 355/298

[58] Field of Search ..... 355/296, 297, 299, 301; 15/256.51, 256.52; 101/425; 430/125; 118/652

[56] References Cited

U.S. PATENT DOCUMENTS 4,158,498 6/1979 Ohmori ..... 355/299

FOREIGN PATENT DOCUMENTS 137279 6/1988 Japan .

*Primary Examiner*—Arthur T. Grimley
*Assistant Examiner*—Christopher Horgan
*Attorney, Agent, or Firm*—Oblon, Spivak, McClelland, Maier and Neustadt

[57] ABSTRACT

A cleaning device for an electrophotographic apparatus for removing toner particles which remain on a photoconductive element after image transfer. A cleaning blade is movable into contact with the photoconductive element for removing toner particles. A scraping member is held in contact with the cleaning blade by a predetermined pressure to scrape the toner particles off the cleaning blade. When the cleaning blade is moved toward the photoconductive element, an urging member or a resilient member urges the scraping member away from the cleaning blade. The cleaning blade is, therefore, prevented from exerting a load on the scraping member while the cleaning blade cleans the photoconductive element.

16 Claims, 5 Drawing Sheets

CLEANING DEVICE FOR AN ELECTROPHOTOGRAPHIC APPARATUS

BACKGROUND OF THE INVENTION

The present invention relates to an electrophotographic apparatus having a photoconductive element or similar image carrier and, more particularly, to a cleaning device for removing toner particles which remain on the image carrier after image transfer.

An electrophotographic copier, facsimile machine, laser printer or similar electrophotographic apparatus is extensively used which forms an electrostatic latent image on a photoconductive element, or image carrier, and develops the latent image by a developer such as a toner. In this kind of apparatus, after the transfer of the developed image or toner image to a paper sheet or similar recording medium, a part of the developer or toner is left non-transferred on the photoconductive element. The apparatus, therefore, usually includes a cleaning device for removing such residual toner particles from the photoconductive element. The cleaning device may be implemented by a cleaning blade which is made of polyurethan rubber, for example, and held in contact with the photoconductive element for scraping off the toner particles. Another implementation known in the art is the combination of a movable cleaning blade and a scraping member, as disclosed in Japanese Patent Laid-Open Publication (Kokai) No. 63-137279, for example. Specifically, while a cleaning member is movable between a first position where it contacts the photoconductive element and a second position where it is spaced apart from the same, there is a scraping member constituted by a polyester film (e.g. Mylar film available from Du Pont is held in contact with the cleaning blade). When the cleaning blade is moved from the first position to the second position away from the photoconductive element, the scraping member scrapes toner particles off the cleaning blade. A problem with this implemenation is that since the scraping member is fixed in place, the cleaning blade exerts a substantial load on the scraping member while removing residual toner particles from the photoconductive element in the first position. More specifically, the cleaning blade urges the scraping member downward. Such a load deforms the scraping member and thereby brings it out of accurate contact with cleaning blade as the time elapses, resulting in insufficient removal of residual toner.

SUMMARY OF THE INVENTION

It is therefore an object of the present invention to provide a cleaning device for an electophotographic apparatus which reduces the deformation of a scraping member so as to insure the removal of toner from the entire surface of a cleaning blade over a long period of time and thereby removes toner stably over the entire width of a photoconductive element or image carrier over a long period of time.

It is another object of the present invention to provide a generally improved cleaning device for an electrophotographic apparatus.

In accordance with the present invention, a cleaning device for an electrophotographic apparatus having an image carrier comprises a cleaning blade movable between a first position where the cleaning blade contacts the image carrier and a second position where the cleaning blade is spaced apart from the image carrier, a scraping member held in contact with the cleaning blade by a predetermined pressure at a position spaced away from the image carrier, and an urging member movable integrally with the cleaning blade when the cleaning blade is moved between the first and second positions, while urging the scraping member away from the cleaning blade against the predetermined pressure.

Also, in accordance with the present invention, a cleaning device for an electrophotographic apparatus having an image carrier comprises a cleaning blade movable between a first position where the cleaning blade contacts the image carrier and a second position where the cleaning blade is spaced apart from the image carrier, a scraping member held in contact with the cleaning blade at a position spaced away from the image carrier, and a resilient member constantly urging the scraping member against the cleaning blade and, when the cleaning blade is moved from the second position to the first position, exerting a substantially constant resilient force on the scraping member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
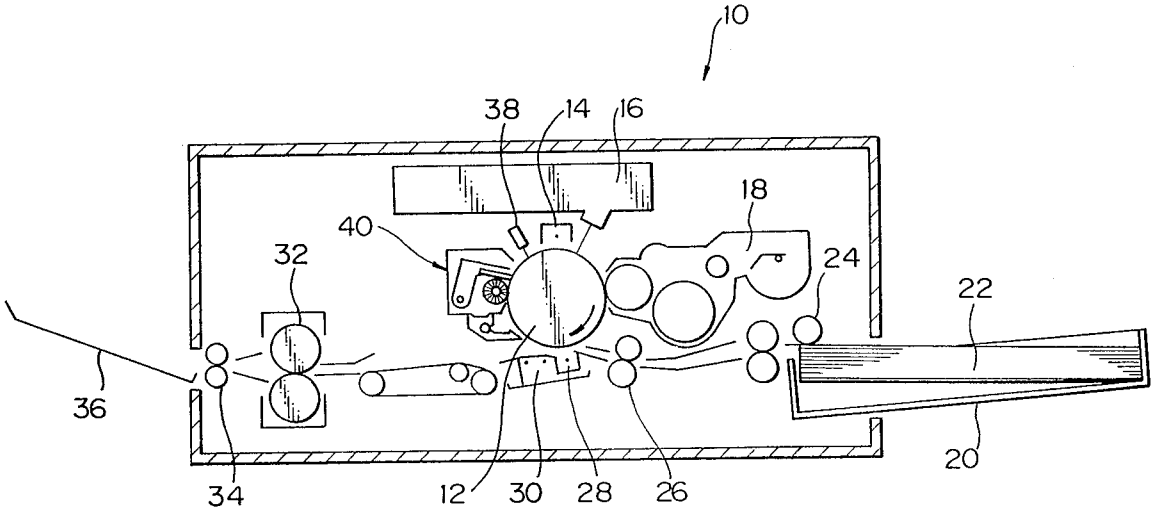
FIG. 1 is a section showing a laser printer belonging to a family of electrophotographic apparatuses to which the present invention is applicable.

Referring to FIG. 1 of the drawings, a laser printer to which the present invention is applied is shown and generally designated by the reference numeral 10. As shown, the laser printer 10 has a photoconductive element in the form of a drum 12 at substantially the central part thereof. The drum 12 is rotated clockwise as indicated by an arrow in the figure. A main charger 14 charges the surface of the drum 12 uniformly in the axial direction of the latter (in a direction perpendicular to the sheet surface of FIG. 1). An optical writing unit 16 incorporates a laser diode, not shown, and exposes the charged surface of the drum 12 imagewise, thereby electrostatically forming a latent image on the drum 12. A developing device 18 develops the latent image on the drum 12 to produce a toner image. A paper tray 20 is loaded with a stack of paper sheets 22 and removably loaded in a lower right portion of the laser printer 10. One paper sheet 22 is fed from the paper tray 20 toward a register roller 26 by a feed roller 24. The register roller 26 drives the paper sheet 22 toward the drum 14 at such a timing that the paper sheet 22 overlies the toner image on the drum 12. Specifically, the paper sheet 22 and the toner image are brought into register at the position where a transfer charger 28 is located. Then, the transfer charger 28 is energized to transfer the toner image from the drum 12 to the paper sheet 22 by discharge. After such image transfer, a separation charger 30 is energized to separate the paper sheet 22 from the drum 12 by discharge. The separated paper sheet 22 is transported to a fixing device 32 to fix the toner image on the paper sheet 22. A discharge roller 34 drives the paper sheet with the fixed toner image out of the printer 10 onto a tray 36.

After the paper sheet 22 has been separated from the drum 22, a cleaning device 40 in accordance with the present invention removes toner particles remaining on the drum 22. Then, a discharge lamp 38 dissipates the charge from the drum 12 to prepare the drum 12 for another printing cycle.

Figure 2:
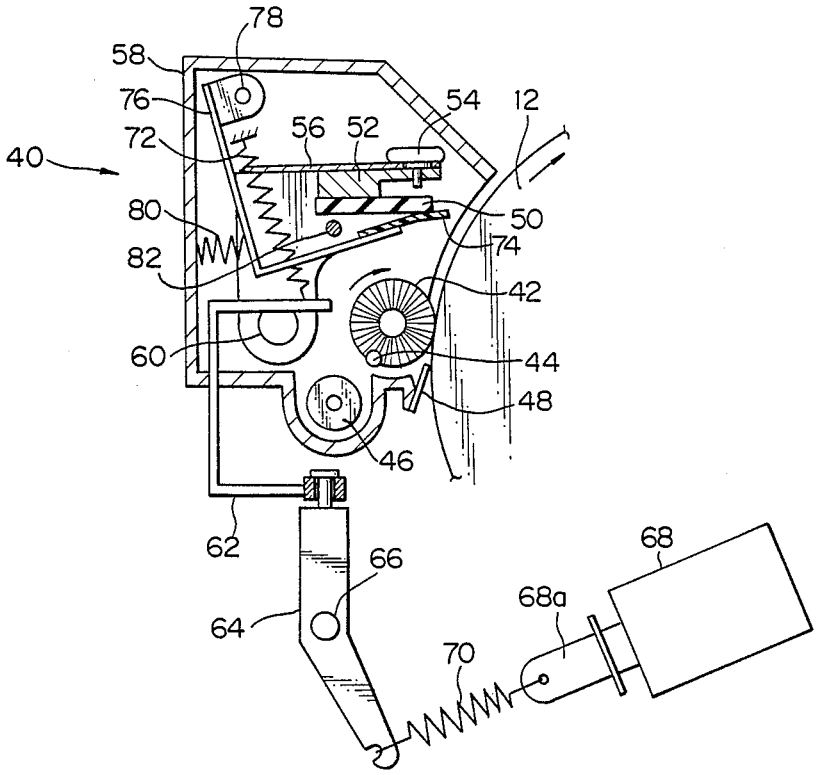
FIGS. 2 and 3 are sectional side elevations showing a cleaning device embodying the present invention.

Referring to FIG. 2, an embodiment of the cleaning device in accordance with the present invention will be described. As shown, the cleaning device 40 has a fur brush 42 which is held in contact with the drum 12. The fur brush 42 is implemented by a conductive tube made of aluminum, for example, and a great number of conductive hairs implanted in the conductive tube. The fur brush 42 is rotated clockwise as viewed in FIG. 2 so as to remove toner particles remaining on the drum 12. A flicker 44 is fixed in place at the lower left of the center of rotation of the brush 42 and is constituted by a cylindrical rod. The flicker 44 bites into the fur brush 42 to a depth of 2 millimeters to 3 millimeters. The toner particles transferred from the drum 12 to the fur brush 42 are beaten down by the flicker 44. A coil 46 is disposed below the flicker 44 to convey the toner particles beaten down by the flicker 44 in a direction perpendicular to the sheet surface of FIG. 2 toward the outside of the cleaning device 40. An inlet seal 48 is a film formed of polyurethane or polyester and serves to prevent toner particles from being scattered around.

Figure 3:
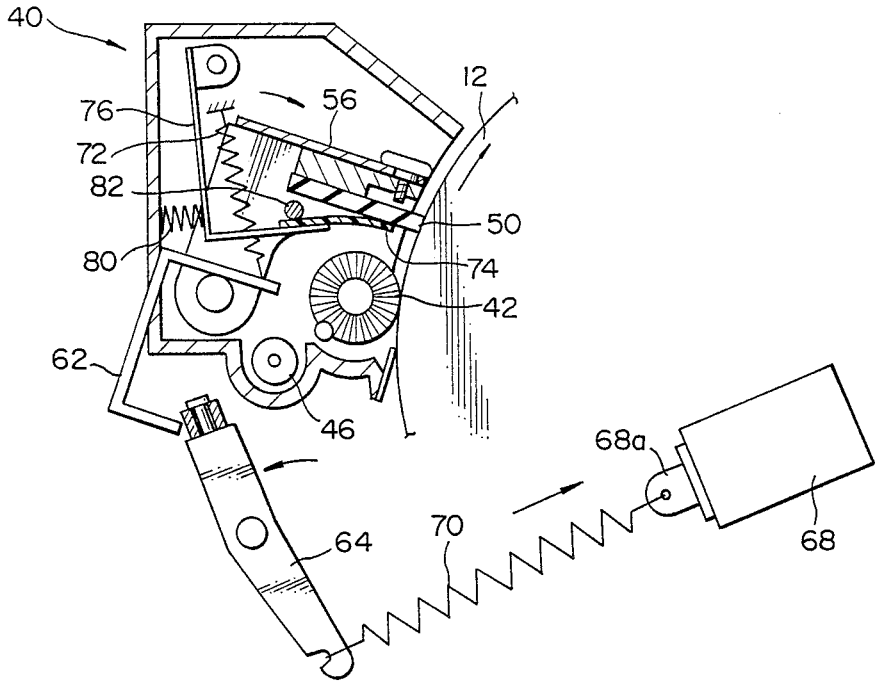

A cleaning blade 50 is made of polyurethan rubber and about 3 millimeters thick. The cleaning blade 50 extends over substantially the entire width of the drum 12 and is retained by a blade holder 52. The blade holder 52 is rotatably connected to a bracket 56 by a stepped screw 54 substantially at the intermediate between opposite lengthwise ends thereof (perpendicular to the sheet surface of the figure). Hence, the blade holder 52 is free to rotate about the screw 54 to cause the cleaning blade 50 into uniform contact with the drum 12. The bracket 56 is rotatably mounted on a shaft 60 which is in turn rigidly supported by a casing 58. The bracket 56 is operatively connected to a plunger or actuator **68*a* of a solenoid 68 by a generally U-shaped lever 62, an arm 64 rotatable about a pin 66, and a tension spring 70. A tension spring 72 is anchored at one end to the upper end of the lever 62 which is affixed to the bracket 56 and at the other end to the casing 58. When the solenoid 68 is not energized, the bracket 56 is urged counterclockwise about the shaft 60 by the spring 72. In this condition, the cleaning blade 50 is spaced apart from the drum 12. On the energization of the solenoid 68, the arm 64 is rotated counterclockwise to in turn cause the lever 62 and thereby the bracket 56 to rotate clockwise, as shown in FIG. 3. As a result, the cleaning blade 50 is brought into contact with the drum 12. While in contact with the drum 12, the cleaning blade 50 scrapes off the drum 12 the toner particles which the fur brush 42 failed to remove. The toner particles removed by the cleaning blade 50 are dropped onto the coil 46 by way of the fur brush 42**.

In FIG. 2, a scraping member 74 is urged against the underside of the cleaning blade 50 in an inclined position. The scraping member 74 is implemented as a polyester film which is about 100 microns thick and is held in contact with the cleaning blade 50 over the entire length of the latter. The scraping member 74 is rigidly connected to a generally L-shaped holder 76 at the left end thereof as viewed in FIG. 2. The holder 76 is rotatable about a shaft 78 which is securely mounted on the casing 58. A compression spring 80 is preloaded between the holder 76 and the casing 58 to constantly bias the holder 76 counterclockwise. The scraping member 74 is urged against the cleaning blade 50 by an adequate pressure which is determined by the preload of the spring 80. In the position shown in FIG. 3, the cleaning blade 50 removes toner particles from the drum 12 while, in a stand-by condition or the like, it is shifted to the position shown in FIG. 2. During the movement from the FIG. 3 position to the FIG. 2 position, the blade 50 slides on the scraping member 74. The scraping member 74, therefore, scrapes the toner particles off the cleaning blade 50 and thereby maintains the blade 50 clean at all times.

As shown in FIGS. 2 and 3, a pressing member 82 having a cylindrical section is mounted on the bracket 56 slightly below the cleaning blade 50. When the cleaning blade 50 is spaced apart from the drum 12 as shown in FIG. 2, the pressing member 82 is also spaced away from the holder 76. As the cleaning blade 50 is shifted from the position shown in FIG. 2 to the position shown in FIG. 3, the pressing member 82 contacts the holder 76 and urges it downward away from the cleaning blade 50. As a result, the holder 76 and, therefore, the scraping member 74 is pressed downward against the action of the spring 80. This prevents the cleaning blade 50 from exerting a heavy load on the scraping member 74. Since the scraping member 74 is relatively thin, it is apt to wave or otherwise deform with the lapse of time when subjected to substantial loads. Such deformation would degrade the function of the scraping member 74 for removing toner particles from the cleaning blade 50. The illustrative embodiment eliminates this problem because the scraping member 74 is free from deformation.

While the scraping member 74 has been shown and described as being biased by the compression spring 80, the holder 76 itself may be made of a resilient material so as to bias the scraping member 74.

Figure 4:
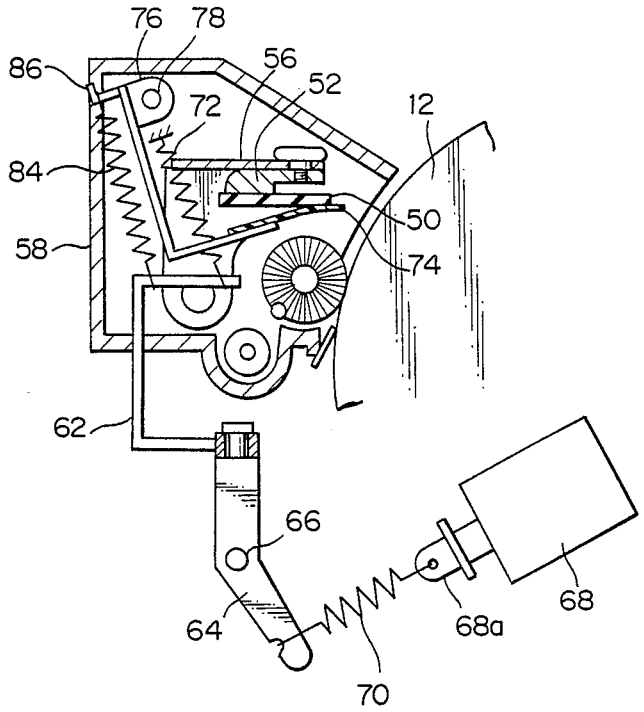
FIGS. 4 and 5 are views similar to FIGS. 2 and 3, showing an alternative embodiment of the cleaning device in accordance with the present invention.
Figure 5:
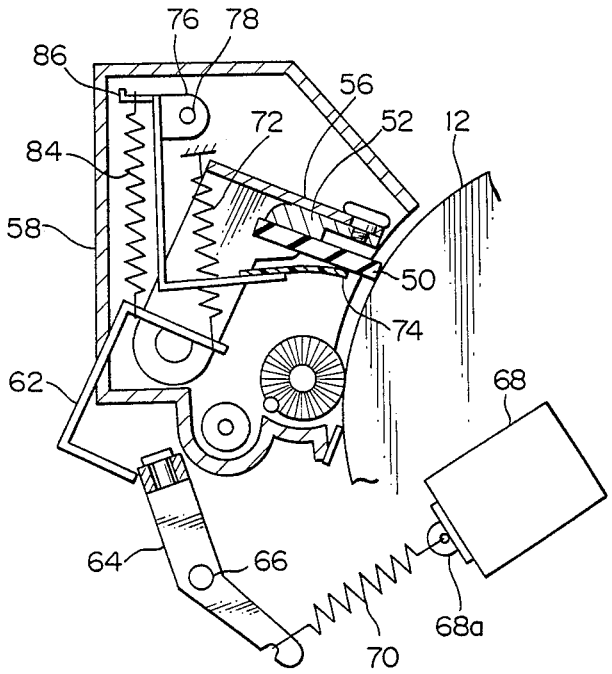

FIGS. 4 and 5 show an alternative embodiment of the present invention and correspond to FIGS. 2 and 3, respectively. This alternative embodiment differs from the previous embodiment in that the pressing member 82 is absent, and in that the compression spring 80 adapted to urge the scraping member 74 against the cleaning blade 50 is replaced with a tension spring 84. The rest of the construction of the cleaning device shown in FIGS. 4 and 5 is the same as the cleaning device shown in FIGS. 2 and 3. The tension spring 84 is anchored at its lower end to the lever 62 and at the upper end to a hook 86 which extends from the upper end of the holder 76 to the left as viewed in the figures. When the bracket 56 is rotated clockwise to in turn move the cleaning blade 50 to the position shown in FIG. 5, the lever 62 is moved together with the bracket 56. By this rotation, the length of the tension spring 84 is maintained the same as in the position shown in FIG. 4. Hence, the resilient force acting on the scraping member 74 is maintained constant despite the movement of the cleaning blade 50, i.e., the scraping member 74 is freed from a substantial load even when the cleaning blade 50 contacts the drum 12 (position shown in FIG. 5). Of course, to maintain the force of the tension spring 84 constant, it is necessary that the spring 84 be anchored in particular positions which maintain the distance between the point where the force of the spring 84 acts on the lever 62 and the point where it acts on the holder 76 substantially constant with no regard to the rotation of the bracket 56.

In summary, it will be seen that the present invention provides a cleaning device for an electrophotographic apparatus in which a scraping member is biased away from a cleaning blade by a pressing member and, therefore, freed from a heavy load otherwise acting thereon when the cleaning blade contacts a photoconductive element. Since a resilient force acting on the scraping member is maintained constant even when the cleaning blade is moved, the scraping member is prevented from being deformed. The scraping member free from deformation as mentioned is capable of positively removing toner particles from the cleaning blade over a long period of time, whereby the cleaning blade is allowed to clean the photoconductive element over a long period of time.

Various modifications will become possible for those skilled in the art after receiving the teachings of the present disclosure without departing from the scope thereof.

What is claimed is:

1. A cleaning device for an electrophotographic apparatus having an image carrier, comprising:

a cleaning blade movable between a first position where said cleaning blade contacts the image carrier and a second position where said cleaning blade is spaced apart from said image carrier;

a scraping member held in contact with said cleaning blade by a predetermined pressure at a position spaced away from the image carrier; and an urging member movable integrally with said cleaning blade when said cleaning blade is moved between said first position and said second position, while urging said scraping member away from said cleaning blade against said predetermined pressure.

2. A cleaning device as claimed in claim 1, wherein said cleaning blade is made of polyurethane rubber.

3. A cleaning device as claimed in claim 1, wherein said scraping member comprises a polyester film.

4. A cleaning device as claimed in claim 1, wherein said pressing member has a cylindrical section.

5. A cleaning device as claimed in claim 1, further comprising a mechanism for moving said cleaning blade between said first position and said second position.

6. A cleaning device as claimed in claim 5, wherein said mechanism comprises:

a bracket supporting said cleaning blade and rotatable about a shaft which is securely mounted on said cleaning device;

a solenoid for driving said bracket in a rotary motion;

a transmitting member for transmitting a force of said solenoid to said bracket; and a spring constantly biasing said bracket such that said cleaning blade remains in said second position.

7. A cleaning device as claimed in claim 1, further comprising biasing means for causing said scraping member into contact with said cleaning blade.

8. A cleaning device as claimed in claim 7, wherein said biasing means comprises a holder holding said scraping member and rotatable about a shaft which is securely mounted on said cleaning device, and a spring constantly biasing said scraping member into contact with said cleaning blade.

9. A cleaning device for an electrophotographic apparatus having an image carrier, comprising:

a cleaning blade movable between a first position where said cleaning blade contacts the image carrier and a second position where said cleaning blade is spaced apart from said image carrier;

a scraping member held in contact with said cleaning blade at a position spaced away from the image carrier; and a resilient member constantly urging said scraping member against said cleaning blade and, when said cleaning blade is moved from said second position to said first position, exerting a substantially constant resilient force on said scraping member.

10. A cleaning device as claimed in claim 9, wherein said cleaning blade is made of polyurethane rubber.

11. A cleaning device as claimed in claim 9, wherein said scraping member comprises a polyester film.

12. A cleaning device as claimed in claim 9, wherein said resilient member comprises a spring.

13. A cleaning device as claimed in claim 9, further comprising a mechanism for moving said cleaning blade between said first position and said second position.

14. A cleaning device as claimed in claim 13, wherein said mechanism comprises:

a bracket supporting said cleaning blade and rotatable about a shaft which is securely mounted on said cleaning device;

a solenoid for driving said bracket in a rotary motion;

a transmitting member for transmitting a force of said solenoid to said bracket; and a spring constantly biasing said bracket such that said cleaning blade remains in said second position.

15. A cleaning device as claimed in claim 9, further comprising biasing means for causing said scraping member into contact with said cleaning blade.

16. A cleaning device as claimed in claim 15, wherein said biasing means comprises a holder holding said scraping member and rotatable about a shaft which is securely mounted on said cleaning device, and a spring urging said scraping member against said cleaning blade.

* * * * *